US006120310A

United States Patent [19]

Chang

[11] Patent Number: 6,120,310

[45] Date of Patent: Sep. 19, 2000

[54] SWITCH DEVICE FOR ELECTRICAL CARD CONNECTOR

[75] Inventor: Yao-Hao Chang, Chung-Ho, Taiwan

[73] Assignee: Hon Hai Precision Ind. Co., Ltd., Taipei Hsien, Taiwan

[21] Appl. No.: 09/306,019

[22] Filed: May 6, 1999

[30] Foreign Application Priority Data

May 8, 1998 [TW] Taiwan ..... 87207130

[51] Int. Cl.[7] ..... H01R 29/00

[52] U.S. Cl. ..... 439/188

[58] Field of Search ..... 439/188, 489; 235/441

[56] References Cited

U.S. PATENT DOCUMENTS 5,334,827 8/1994 Bleier et al. ..... 439/188

5,395,259 3/1995 Casses ..... 439/188

*Primary Examiner*—Lincoln Donovan

*Assistant Examiner*—Javaid Nasri

*Attorney, Agent, or Firm*—Wei Te Chung

[57] ABSTRACT

An electrical card connector includes a rectangular dielectric housing having a front side from which a card is horizontally inserted into the connector, a rear side opposite the front side, a lower wall interferentially engaging with a number of contacts and defining a card receiving space above the contact passageways and an upper wall opposite the lower wall. A spring lever is integrally formed with the housing, having a free end located about the rear side of the housing, a root connecting with the housing, and a ramp extending upwardly and rearwardly from the root through the card receiving space to the free end. When the card is inserted into the connector, a leading edge of the card runs through the ramp of the spring lever to depress vertically the free end thereof. The free end in turn depresses vertically a movable part of a switch device in the housing to cause the switch to shift from a state to a different state. Thus, a condition that the inserted card reaches a position to electrically engage with the connector is determined.

9 Claims, 6 Drawing Sheets

SWITCH DEVICE FOR ELECTRICAL CARD CONNECTOR

BACKGROUND OF THE INVENTION

1. Field of The Invention

The present invention generally relates to an electrical card connector, and particular to a smart card connector having an improved switch device for detecting a card inserted into the connector having reached a position electrically engaging with contacts of the connector.

2. The Prior Art

Following the development of communication and computer technology, a number of cards are devised to meet different requirements. To facilitate a mainframe to read the information stored in these cards, card connectors are used. Such card connectors can be referred to U.S. Pat. Nos. 4,735,578, 4,752,234, 4,900,273, and 5,013,255. Taking U.S. Pat. No. 5,013,255 as an example, referring to FIG. 6, a card connector 2 is disclosed having a housing with a base 20 defining two spaces 201 receiving a number contacts 21 therein. These contacts 21 are used for engaging with electrical pads 251 on the card 25, whereby information stored in the card 25 can be read by the mainframe (not shown) via the connector 2. To make sure that the card 25 inserted into the connector 2 has reached a preset position where the card 25 electrically engages with the contacts 21, the card connector 2 has a switch device 22 consisting of a movable terminal 220 and a fixed terminal 23. The switch device 22 is a normal close switch device, which means that a contact portion 221 of the movable terminal 220 disengages from the fixed terminal 23 only when the card 25 inserted into the connector 2 has reached the preset position. Also referring to FIG. 7, since the moving direction of the movable terminal 220 is the same as the inserting direction "A" of the card 25 into the connector 2, a rebounding force of the movable terminal 220 generated by the card 25 pushing an arced portion 223 of the movable terminal 220 may cause a displacement of the card 25 away from its electrical engagement with the contacts 21. When this happens, an erroneous information reading of the mainframe from the card 25 occurs.

Hence, an electrical card connector with an improved switch device is needed to eliminate the above mentioned defects of current electrical card connectors.

SUMMARY OF THE INVENTION

Accordingly, an objective of the present invention is to provide an electrical card connector having a switch device consisting of a movable terminal and a fixed terminal, wherein a rebounding force generated by the movable terminal due to an insertion of a card into the connector will not cause the card to separate from its engagement with contacts of the connector.

To fulfill the above mentioned objective, according to one embodiment of the present invention, an electrical card connector for connecting an electronic card to a mainframe includes a rectangular housing, a number of contacts fixed in the housing for electrically engaging with the electronic card, and a switch device mounted in the housing for detecting whether the card inserted into the connector has reached a preset position in which the card electrically engages with the contacts of the connector. The housing defines a first direction along which the card is inserted into the connector to be received in a card receiving space defined in the housing, and a second direction perpendicular to the first direction. Furthermore, the housing integrally forms a spring lever with a form like a cantilevered beam, having a free end located above the switch device, a root connecting with the housing, and a ramp extending upwardly from the root through the card receiving space to the free end. When the card inserted into the card connector reaches the preset position, a leading edge of the card runs through the ramp to a position over the free end of the spring lever. The free end of the spring lever is depressed by the leading edge of the card, whereby a movable terminal of the switch device is depressed by the free end of the spring lever to leave its normal engagement with a fixed terminal of the switch device along the second direction. Thus, a condition that the inserted card electrically engages with the connector is determined.

DETAILED DESCRIPTION OF THE PREFERRED EMBODIMENT

Reference will now be made in detail to the preferred embodiment of the present invention.

Figure 1:
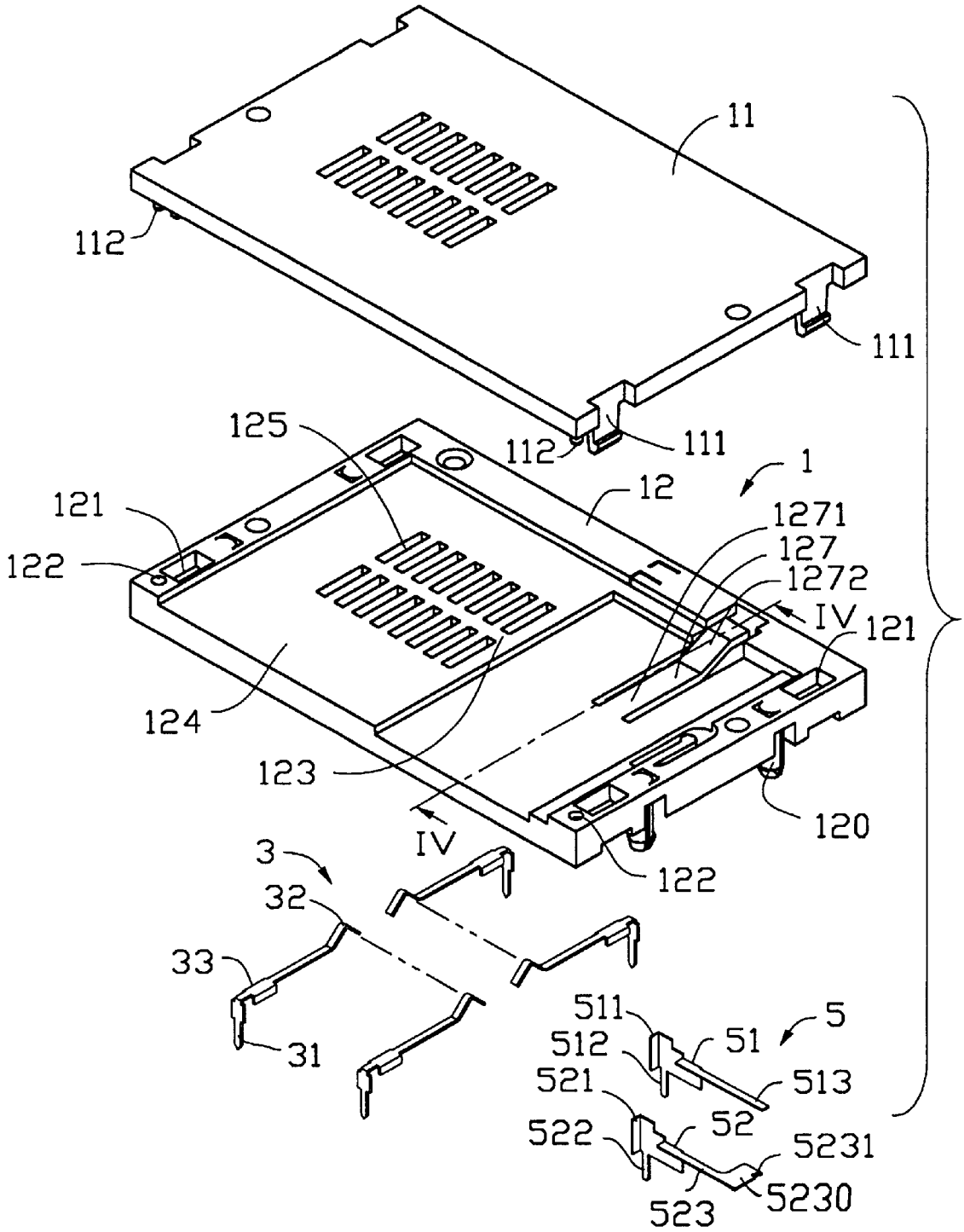
FIG. 1 is an exploded view showing constituting components of an electrical card connector in accordance with the present invention.
Figure 2:
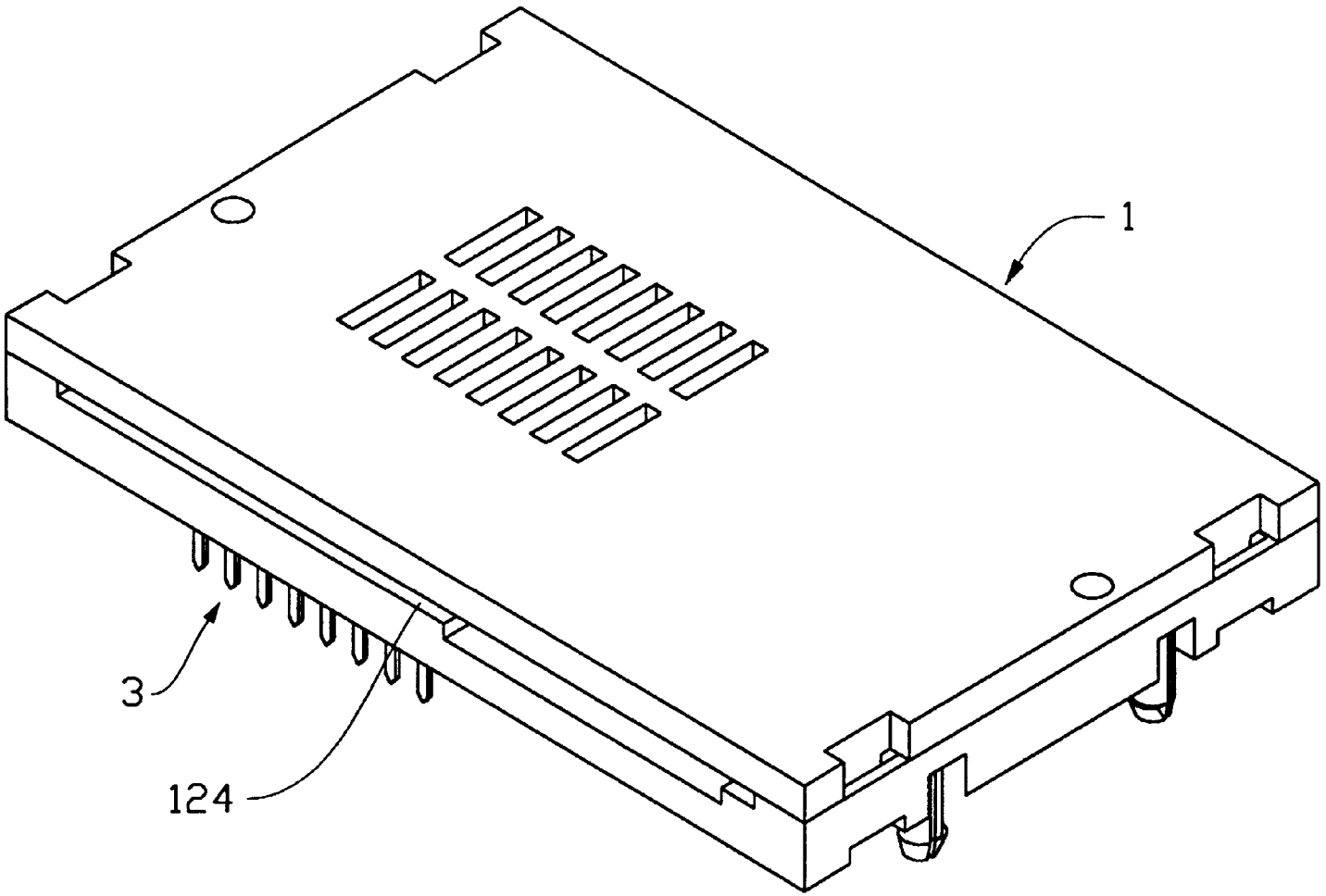
FIG. 2 is a perspective view of the assembled electrical connector of FIG. 1.
Figure 3:
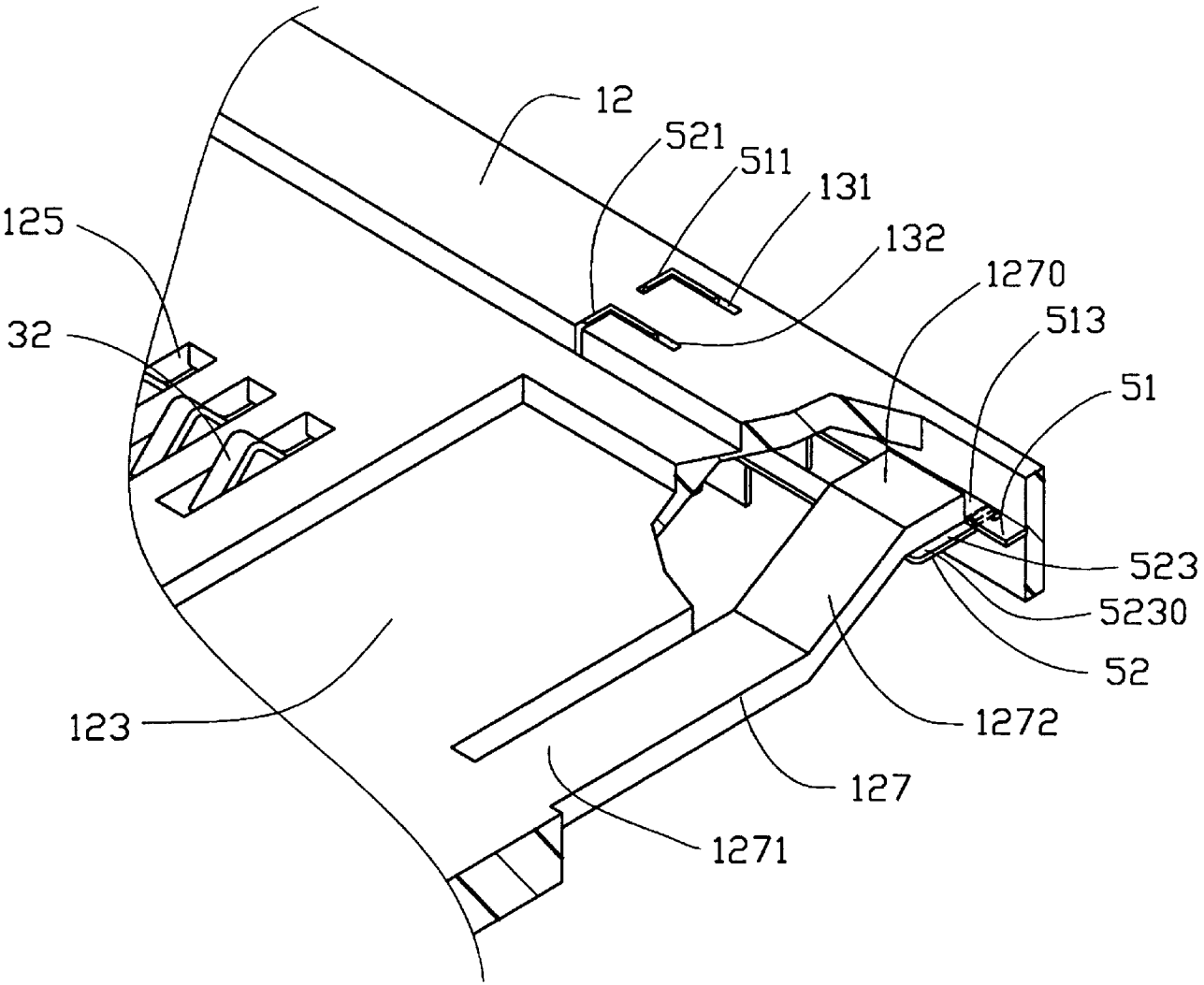
FIG. 3 is an enlarged, partly cut-away perspective view of the connector of FIG. 1 with a cover thereof being removed.

Referring to FIGS. 1–3, a card connector in accordance with the present invention includes a rectangular housing 1, a number of contacts 3, and a switch device 5. The housing 1 consists of a cover 11 and a base 12, wherein the cover 11 is formed with four engaging hooks 111 at its four corners and two posts 112 near the two hooks about an inlet side of the connector. The base 12 defines four rectangular holes 121 corresponding to the four hooks 111, and two round holes 122 corresponding to the posts 112. When the cover 11 and the base 12 are assembled, the posts 112 extend into the round holes 122 and the hooks 111 extend through the rectangular holes 121 to fixedly engage with a bottom face of the base 12, and an inlet 124 of the connector is formed, through which an electronic card 7 (FIG. 4) can be inserted into the connector.

The base 12 defines a number of contact passageways 125 extending in a front-to-rear direction for interferentially receiving the contacts 3. Four boardlocks 120 are integrally formed with the base 12 and extend downwardly from the bottom face thereof. The boardlocks 120 are used to position the connector to a printed circuit board (PCB, not shown) on which the connector is mounted before the contacts 3 of the connector are soldered to the PCB. A card receiving space 123 is defined in the base 12 above the contact passageways 125 for receiving the inserted card 7.

Each contact 3 includes a contact portion 32 for extending into the card receiving space 123 to electrically engage with contact pads (not shown) on the card 7, a fitting portion 33 for being interferentially received in a corresponding contact passageway 125, and a tail portion 31 for extending downwardly beyond the bottom face of the base 12 to be soldered to the PCB.

A spring lever 127 is integrally formed with the base 12 in the form of a cantilevered beam, having a free end 1270 extending to a rear side of the base 12. The spring lever 127 is located beside the contact passageways 125 and extends in a direction the same as the contact passageways 125. The spring lever 127 has a root 1271 connected with the base 12 and located below the card receiving space 123, a ramp 1272 extending upwardly and rearwardly from the root 1271 through the card receiving space 123 to the free end 1270 of the lever 127.

The switch device 5 consists of a fixed terminal 51 and a movable terminal 52 each substantially have an L-shaped fitting portion 511, 521. A tail portion 512 (522) extends downward from the fitting portion 511 (521). A contact portion 513 extends sidewardly from the fitting portion 511. A manipulating portion 523 extends sidewardly from the fitting portion 521 and a contact tab 5231 extends rearwardly from a free end 5230 of the manipulating portion 523.

The base 12 defines two L-shaped slits 131 and 132 in a rear portion thereof. The slits 131, 132 are aligned with each other in the front-to-rear direction, wherein the slit 131 is located rear of the slit 132. The fitting portion 511 of the fixed terminal 51 is interferentially fitted into the slit 131. The fitting portion 521 of the movable terminal 52 is interferentially fitted into the slit 132. The tail portions 512, 522 extend downwards beyond the bottom face of the base 12 for being soldered to the PCB. The contact portion 513 of the fixed terminal 51 horizontally extends abutting the bottom face of the base 12. The manipulating portion 523 of the movable terminal 52 horizontally extends along the bottom face of the base 12, spaces from the contact portion 513 of the fixed terminal 51 a distance, and has the free end 5230 thereof located below the free end 1270 of the spring lever 127. The switch 10 device 5 is a normal close switch device: the contact tab 5231 of the movable terminal 52 extends to normally engage with a bottom face of a free end of the contact portion 513 of the fixed terminal 51 when there is no card inserted into the connector to reach a preset position in which the contact pads on the card electrically engage with the contact portions 32 of the contacts 3.

Figure 4:
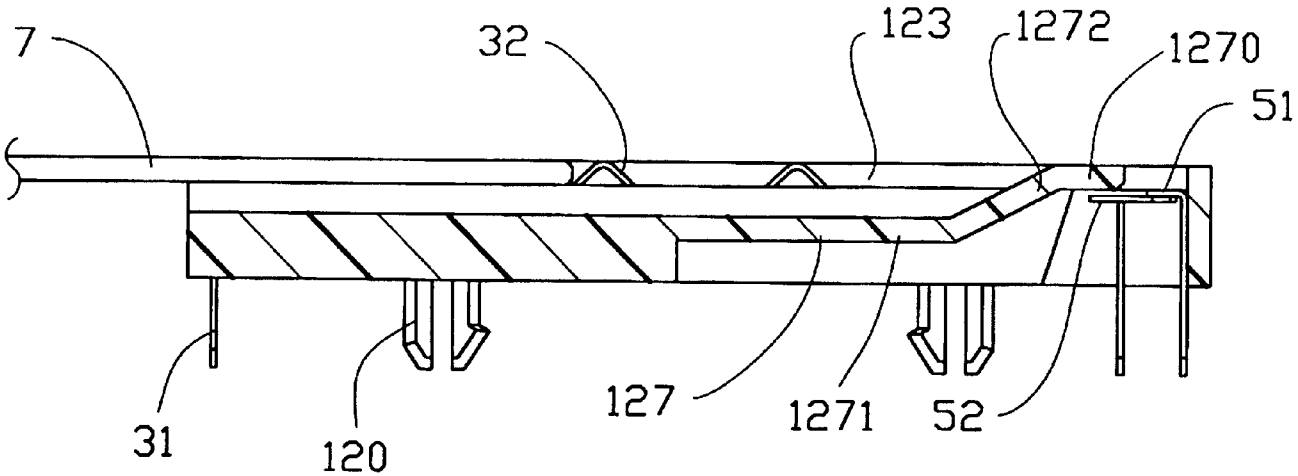
FIG. 4 is a cross-sectional view taken along line IV—IV of FIG. 1, with a card inserted into the connector of the present invention which has not reached a preset position.
Figure 5:
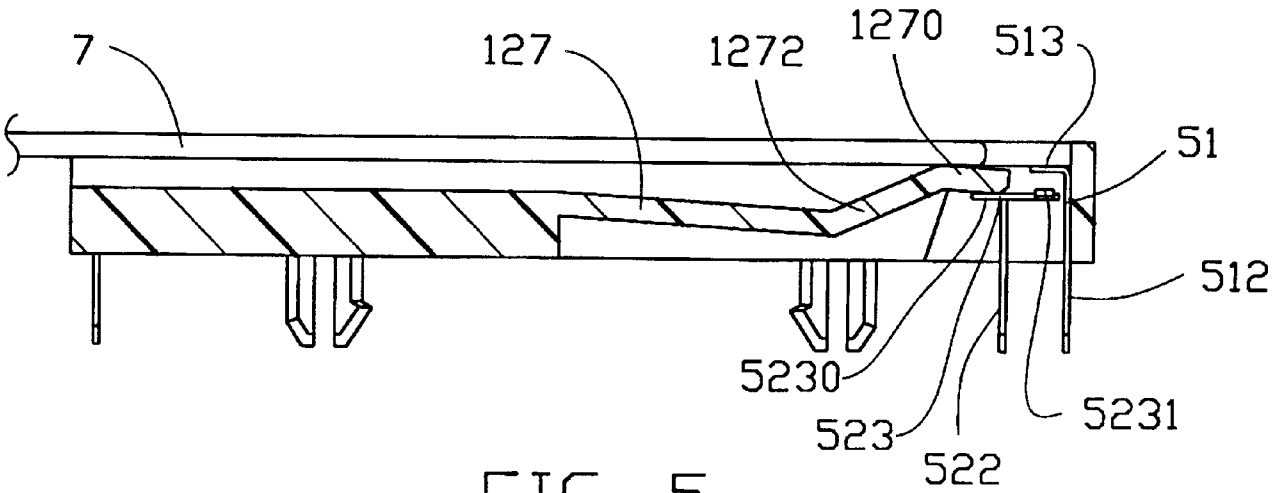
FIG. 5 is a view similar to FIG. 4, showing the inserted card has reached the preset position where the contacts of the connector properly engage with the card, and the switch is activated from a close position to an open position.
Figure 6:
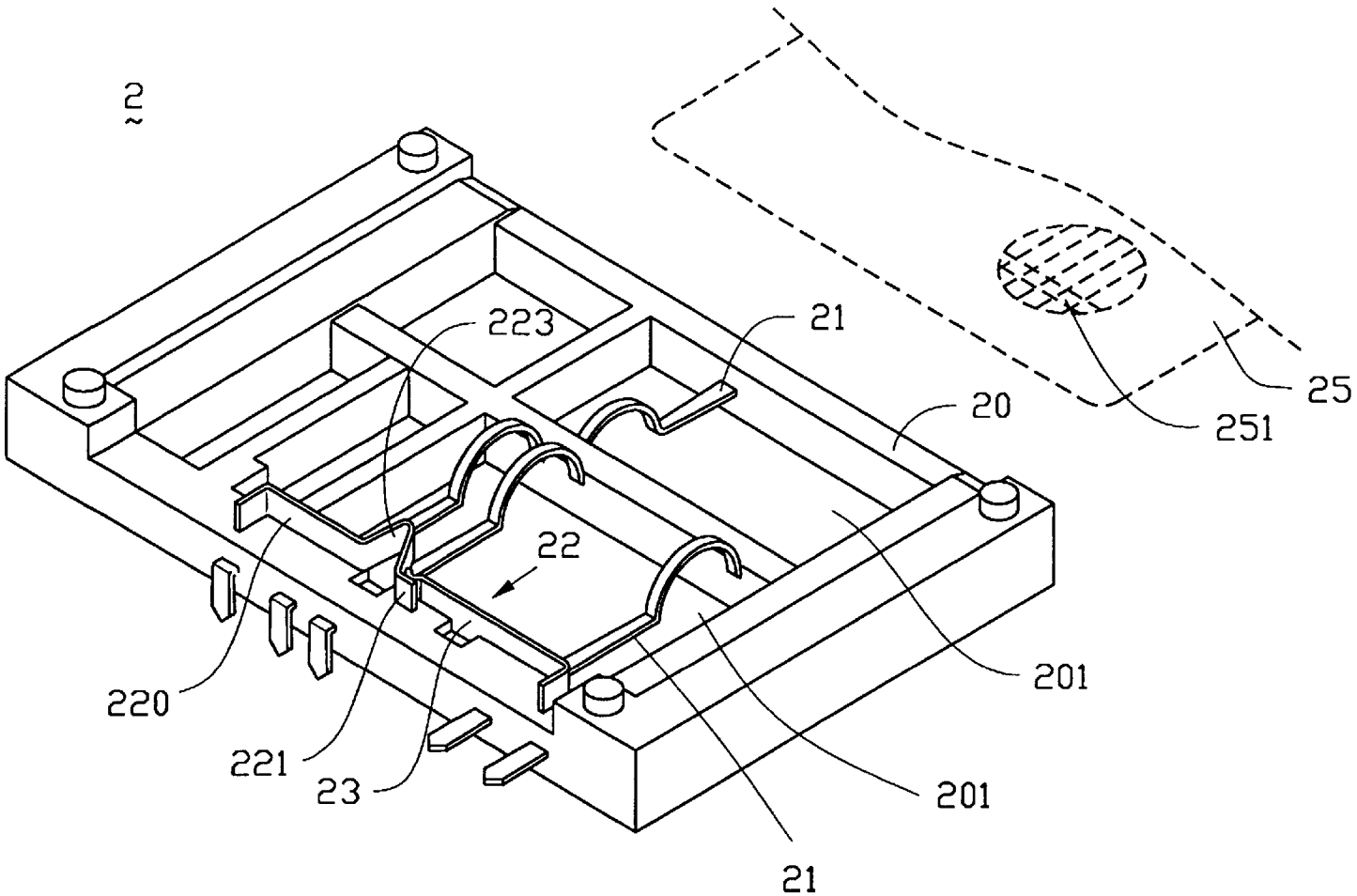
FIG. 6 (PRIOR ART)
FIG. 6 is a perspective view showing a part of a card connector in accordance with prior art, and a smart card to be inserted into the connector.
Figure 7:
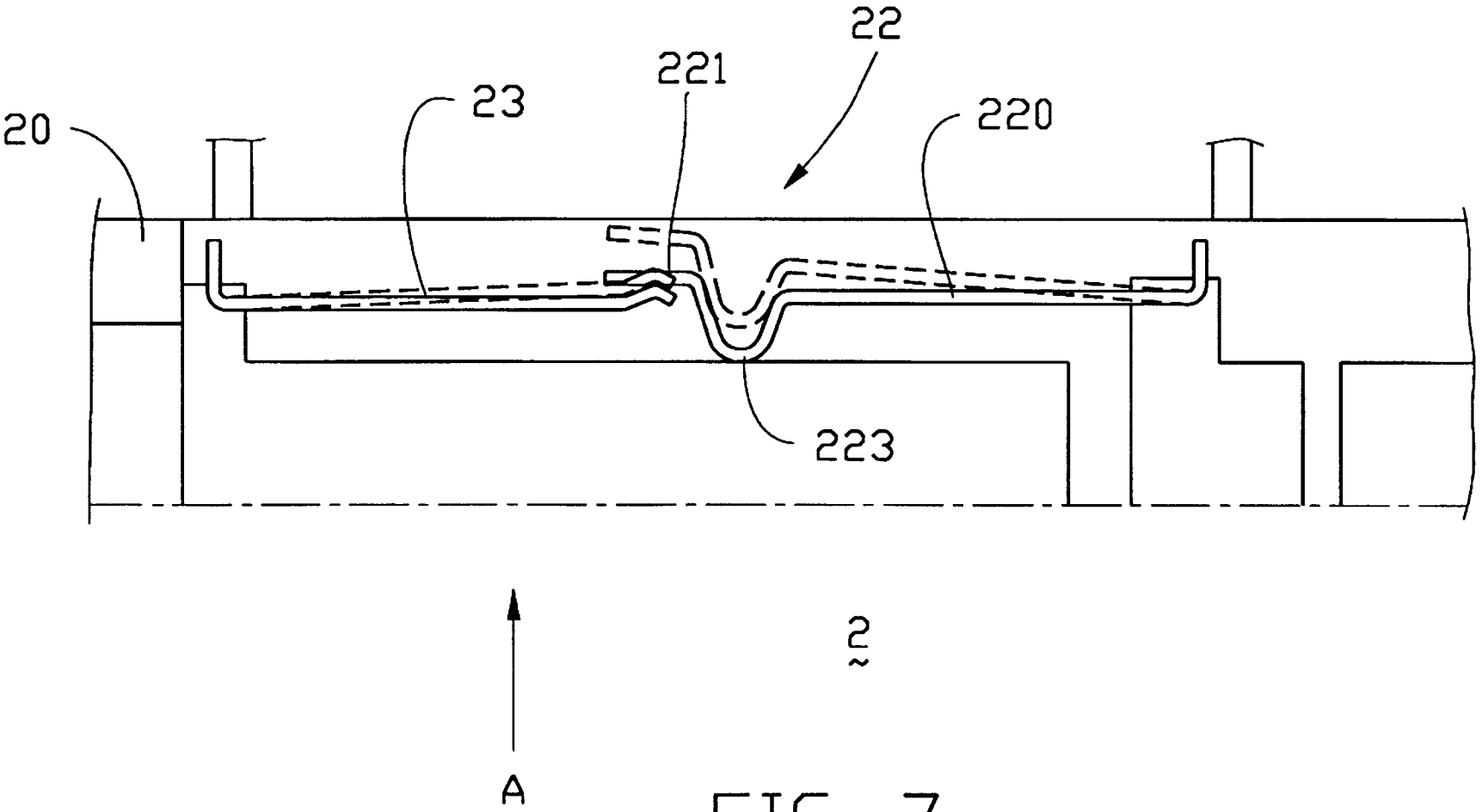
FIG. 7 (PRIOR ART)
FIG. 7 is a diagrammatic view showing a movement of a switch device of the connector in response to an insertion of a card into the connector of FIG. 6.

Referring to FIGS. 4 and 5, when the card 7 is inserted into the connector, a leading edge of the card 7 runs firstly through the contact portions 32 of the contacts 3, then the ramp 1272 of the spring lever 127 and finally over the free end 1270 of the spring lever 127, whereby the free end 1270 is activated to move downwardly a distance. The downward movement of the free end 1270 in turn presses downwardly the free end of the manipulating portion 523 of the movable terminal 52 of the switch device 5. Thus, the contact tab 5231 of the movable terminal 52 is moved downwardly to separate from its engagement with the contact portion 513 of the fixed terminal 51 so that the switch device 5 is shifted from the normal close position to an open position, whereby the card 7 is inserted into the connector to properly engage with the contacts 3 is determined.

Since in the present invention, a rebounding force generated by the movable terminal 52 acts on a direction perpendicular to the inserting direction of the card 7 into the connector, the proper engagement between the card 7 and the contacts 3 will not be adversely affected by the rebounding force.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical card connector for connecting an electronic card to a mainframe, comprising:

a dielectric housing including a rectangular configuration which defines a front side from which the electronic card is inserted into the connector, a rear side opposite the front side, a top face between the front and rear sides, and a bottom face opposite the top face, the housing defining a first direction from the front side to the rear side for receiving a card inserted into the connector, and a second direction from the top face to the bottom face substantially perpendicular to the first direction, the housing having a plurality of contact passageways and a card receiving space above the contact passageways and forming a spring lever in the form of a cantilevered beam extending in the first direction with a free end located about the rear side of the housing, a root connecting with the housing, and a ramp extending upwardly and rearwardly from the root to the free end of the spring lever, a number of contacts received in the contact passageways for electrically engaging with the inserted card; and a switch device mounted in the housing and including a movable part located below the free end of the spring lever, the movable part being movable in the second direction between a first position and a second position in response to an insertion of the card into the connector.

2. The electrical connector in accordance with claim 1, wherein at the first position, the switch is at a close state, and at the second position, the switch is at an open state.

3. The electrical connector in accordance with claim 1, wherein the movable part of the switch device moves from the first position to the second position by the inserted card reaching a preset position in which the card properly electrically engages with the contacts.

4. The electrical connector in accordance with claim 1, wherein the switch has a fixed part secured to the housing and the movable part is engaged with the fixed part when there is no card inserted into the connector.

5. The electrical connector in accordance with claim 4, wherein each of the movable and fixed parts has a fitting portion interferentially engaging with the housing and a tail portion extending downwardly beyond the bottom face of the housing for being soldered to a printed circuit board, the fixed part having a contact portion extending abutting the bottom face of the housing, the movable part having a manipulating portion extending beside the contact portion of the fixed part and a contact tab extending substantially perpendicularly to the manipulating portion to reach a position below the contact portion of the fixed part.

6. The connector in accordance with claim 5, wherein the manipulating portion of the movable part has a free end distant from the fitting portion thereof, the free end of the spring lever being located above the free end of the manipulating portion, the contact tab of the movable part being extended from the free end of the manipulating portion to a position below the contact portion of the fixed part.

7. The connector in accordance with claim 6, wherein the housing consists of a cover and a base, the contact passageways being defined in the base, the card receiving space being located above the contact passageways, the cover being connected to the base by extending a number of hooks formed by the cover through the base to fixedly engage with the bottom face of the base.

8. The connector in accordance with claim 7, wherein the cover further comprises a number of posts extending into round holes defined in the base.

9. The connector in accordance with claim 7, wherein the base further comprises a number of boardlocks downwardly extending from the bottom face of the base for engaging with the printed circuit board.

* * * * *